US012490811B2

(12) United States Patent
Steele et al.

(10) Patent No.: US 12,490,811 B2
(45) Date of Patent: Dec. 9, 2025

(54) FOOTWEAR COMPRISING RIGID CAGE AND VARIABLE PADDING ELEMENT

(71) Applicant: adidas AG, Herzogenaurach (DE)

(72) Inventors: Cori Marble Steele, Portland, OR (US); Joseph Thomas Broccoli-Hickey, Portland, OR (US); Gillian Pinder, Portland, OR (US); Nicole Schrier, Vancouver, WA (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/541,950

(22) Filed: Dec. 15, 2023

(65) Prior Publication Data

US 2025/0194747 A1 Jun. 19, 2025

(51) Int. Cl.

| | |
|---|---|
| ***A43B 23/02*** | (2006.01) |
| ***A43B 23/16*** | (2006.01) |
| ***A43B 23/17*** | (2006.01) |

(52) U.S. Cl.

CPC ..... *A43B 23/0235* (2013.01); *A43B 23/0205* (2013.01); *A43B 23/16* (2013.01); *A43B 23/17* (2013.01)

(58) Field of Classification Search

CPC ..... A43B 23/088; A43B 23/16; A43B 23/17; A43B 23/0235; A43B 23/028

See application file for complete search history.

(56) References Cited

U.S. PATENT DOCUMENTS

| | | | | |
|---|---|---|---|---|
| 3,191,321 | A * | 6/1965 | Brutting | A43B 5/02 36/77 R |
| 4,594,798 | A * | 6/1986 | Autry | A43B 23/17 36/114 |
| 5,339,544 | A * | 8/1994 | Caberlotto | A43B 23/0255 36/43 |
| 7,089,690 | B2 * | 8/2006 | Krstic | A43B 23/028 36/3 R |
| 7,168,188 | B2 | 1/2007 | Auger et al. | |
| 8,505,216 | B2 | 8/2013 | Sokolowski et al. | |
| 10,172,417 | B2 * | 1/2019 | Hoffer | A43B 13/141 |
| 10,258,107 | B2 * | 4/2019 | Surace | A43B 7/20 |
| 10,285,468 | B2 | 5/2019 | Van Atta et al. | |
| 10,646,000 | B2 | 5/2020 | Doremus et al. | |
| 10,702,018 | B2 | 7/2020 | Beye et al. | |

(Continued)

FOREIGN PATENT DOCUMENTS

| | | | |
|---|---|---|---|
| CN | 203435791 | U | 2/2014 |
| CN | 208318447 | U | 1/2019 |

(Continued)

*Primary Examiner* — Megan E Lynch

(74) *Attorney, Agent, or Firm* — Sterne, Kessler, Goldstein & Fox P.L.L.C.

(57) ABSTRACT

Articles of footwear comprising a rigid cage coupled to a sole and comprising a plurality of openings formed in the cage, and a padding element disposed under the rigid cage and comprising a plurality of projections. The projections can each comprise an exterior protrusion extending from the exterior surface of the padding element and disposed within one of the openings in the rigid cage. The projections can each comprise an interior protrusion extending from an interior surface of the padding element. In some embodiments, the size and shape of the interior and/or exterior protrusions can be based on data from a foot scan map.

19 Claims, 11 Drawing Sheets

(56) References Cited

U.S. PATENT DOCUMENTS

| | | | | |
|---|---|---|---|---|
| 10,779,615 | B2 | 9/2020 | Minami et al. | |
| 11,464,290 | B2 | 10/2022 | Follet et al. | |
| 11,583,033 | B1 * | 2/2023 | Blauer | A43B 13/122 |
| 12,133,572 | B1 * | 11/2024 | Howe | A43B 5/00 |
| 2004/0244226 | A1 * | 12/2004 | Farys | A43B 23/088 36/69 |
| 2005/0188562 | A1 * | 9/2005 | Clarke | A43B 3/244 36/3 R |
| 2006/0010718 | A1 * | 1/2006 | Auger | A43B 21/32 36/69 |
| 2011/0185592 | A1 * | 8/2011 | Nishiwaki | A43B 23/17 36/69 |
| 2015/0189945 | A1 * | 7/2015 | Liang | A43B 23/026 12/146 C |
| 2016/0037862 | A1 * | 2/2016 | Beye | A43B 23/029 36/89 |
| 2016/0095389 | A1 * | 4/2016 | Minami | A43B 23/0245 36/45 |
| 2016/0262494 | A1 * | 9/2016 | Weidl | A43B 23/042 |
| 2017/0164683 | A1 * | 6/2017 | Van Atta | A43B 5/025 |
| 2018/0110292 | A1 * | 4/2018 | Beers | A43B 11/00 |
| 2018/0343976 | A1 * | 12/2018 | Reid | A43B 23/22 |
| 2019/0174874 | A1 * | 6/2019 | Lee | A43D 1/025 |
| 2020/0305552 | A1 * | 10/2020 | Cheney | A43B 23/027 |
| 2021/0177097 | A1 | 6/2021 | Thompsett et al. | |
| 2021/0315323 | A1 * | 10/2021 | Hakkala | A61B 5/0064 |
| 2021/0321718 | A1 * | 10/2021 | Chang | A43B 23/16 |
| 2021/0345725 | A1 | 11/2021 | Arana et al. | |
| 2022/0240625 | A1 * | 8/2022 | Shin | A43B 23/028 |
| 2023/0033366 | A1 * | 2/2023 | Farina | A43B 21/30 |
| 2024/0122300 | A1 * | 4/2024 | Farina | A43B 11/00 |
| 2024/0138523 | A1 * | 5/2024 | Wang | A43B 3/44 |
| 2024/0324727 | A1 * | 10/2024 | Wang | A43B 23/088 |

FOREIGN PATENT DOCUMENTS

| | | | | |
|---|---|---|---|---|
| CN | 208550166 | U | 3/2019 | |
| CN | 214156378 | U | 9/2021 | |
| CN | 217524104 | U | 10/2022 | |
| EP | 2818062 | A1 * | 12/2014 | A41B 11/007 |
| FR | 3042388 | A1 | 4/2017 | |

* cited by examiner

FOOTWEAR COMPRISING RIGID CAGE AND VARIABLE PADDING ELEMENT

FIELD

The described embodiments generally relate to articles of footwear. More particularly, described embodiments relate to footwear comprising a rigid cage and padding element assembly that provides desired support and cushioning for a wearer.

BACKGROUND

The human foot is a complex and remarkable piece of machinery, capable of withstanding and dissipating many loading forces. The natural padding of fat at the heel and forefoot, as well as the numerous joints within the foot help to dissipate and align those loads to the direction of travel. Although the human foot possess natural dampening and alignment characteristics, the foot alone is incapable of effectively overcoming and aligning the many forces encountered during everyday activity. Unless an individual is wearing shoes that provide proper movement and support, the soreness and fatigue associated with every day activity is more acute, and its onset may be accelerated.

Individuals are often concerned with the amount of cushion and support an article of footwear provides. This is true for articles of footwear worn for non-performance activities, such as a leisurely stroll, and for performance activities, such as running and cutting, because throughout the course of an average day, the feet and legs of an individual are subjected to substantial loading forces requiring both impact and torque protection. When an article of footwear contacts a surface, considerable forces may act on the article of footwear and, correspondingly, the wearer's foot. The upper of an article of footwear functions, in part, to provide cushioning to the wearer's foot and to protect it from these forces.

Proper footwear should be durable, comfortable, and provide other beneficial characteristics for an individual. Therefore, a continuing need exists for innovations in footwear.

BRIEF SUMMARY

A first embodiment (1) of the present application is directed to an article of footwear comprising a sole; and an upper coupled to the sole along a bite line, the upper comprising a rigid cage coupled to the sole along at least a portion of the bite line and comprising a plurality of openings formed in the cage, a padding element disposed under the rigid cage and comprising a base layer comprising an exterior surface facing an interior surface of the rigid cage and an interior surface disposed opposite the exterior surface, and a plurality of projections, each of the plurality of projections comprising an exterior protrusion extending from the exterior surface of the base layer and disposed within one of the openings in the rigid cage, and an interior protrusion extending from the interior surface of the base layer.

In a second embodiment (2), the rigid cage according to the first embodiment (1) wraps around a rearfoot portion of the article of footwear to form a heel cage.

In a third embodiment (3), the rigid cage according to the first embodiment (1) or the second embodiment (2) is integrally formed with the sole at the bite line.

In a fourth embodiment (4), the padding element of any one of embodiments (1)-(3) comprises an elastomeric foam.

In a fifth embodiment (5), at least some of the plurality of exterior protrusions according to any one of embodiments (1)-(4) extend outward from the openings of the rigid cage.

In a sixth embodiment (6), the plurality of interior protrusions according to any one of embodiments (1)-(5) comprise a height ranging from 1 mm to 6 mm.

In a seventh embodiment (7), the plurality of interior protrusions according to any one of embodiments (1)-(5) comprise a height, and the height of respective interior protrusions varies on the interior surface of the base layer.

In an eighth embodiment (8), a variation between the height of a shortest interior protrusion and the height of a tallest interior protrusion according to the seventh embodiment (7) is at least 2 mm.

In a ninth embodiment (9), the height of respective interior protrusions according to the seventh embodiment (7) varies based on data from a foot scan map, the data comprising standard deviation values for variations in foot contour measured for a group of individuals.

In a tenth embodiment (10), the plurality of interior protrusions according to any one of embodiments (1)-(9) comprise an effective diameter ranging from 2 mm to 30 mm.

In an eleventh embodiment (11), the plurality of interior protrusions according to any one of embodiments (1)-(9) comprise an effective diameter, and the effective diameter varies on the interior surface of the base layer.

In a twelfth embodiment (12), a variation between the effective diameter of a smallest interior protrusion and the effective diameter of a largest interior protrusion according to the eleventh embodiment (11) is at least 2 mm.

In a thirteenth embodiment (13), the effective diameter of respective interior protrusions according to the eleventh embodiment (11) varies based on data from a foot scan map, the data comprising standard deviation values for variations in foot contour measured for a group of individuals.

In a fourteenth embodiment (14), the plurality of exterior protrusions according to any one of embodiments (1)-(13) comprise a height, and the height of respective exterior protrusions varies on the exterior surface of the base layer.

In a fifteenth embodiment (15), a first plurality of the exterior protrusions according to the fourteenth embodiment (14) comprise a height that extends outward from an exterior surface of the rigid cage, and a second plurality of the exterior protrusions according to the fourteenth embodiment (14) comprise a height disposed below the exterior surface of the rigid cage.

In a sixteenth embodiment (16), the plurality of openings formed in the rigid cage according to any one of embodiments (1)-(15) comprise an effective diameter ranging from 1 mm to 30 mm.

In a seventeenth embodiment (17), the plurality of openings formed in the rigid cage according to any one of embodiments (1)-(15) comprise an effective diameter, and the effective diameter varies on the rigid cage.

In an eighteenth embodiment (18), the base layer and the plurality of projections according to any one of embodiments (1)-(17) are integrally formed as a single piece.

In a nineteenth embodiment (19), the upper according to any one of embodiments (1)-(18) comprises a textile layer coupled to the rigid cage and the padding element.

A twentieth embodiment (20) of the present application is directed to a method of making an article of footwear, the method comprising obtaining a foot scan map comprising standard deviation values for variations in foot contour measured for a group of individuals; forming a padding element, the padding element comprising a base layer comprising an exterior surface and an interior surface disposed opposite the exterior surface, and a plurality of projections, each of the plurality of projections comprising an exterior protrusion extending from the exterior surface of the base layer, and an interior protrusion extending from the interior surface of the base layer, wherein at least one of a height or an effective diameter of respective interior protrusions varies based on the standard deviation values from the foot scan map; and assembling the padding element with a rigid cage for the article of footwear such that the exterior protrusions of the plurality of projections are disposed within corresponding openings formed in the rigid cage.

DETAILED DESCRIPTION

Figure 1:
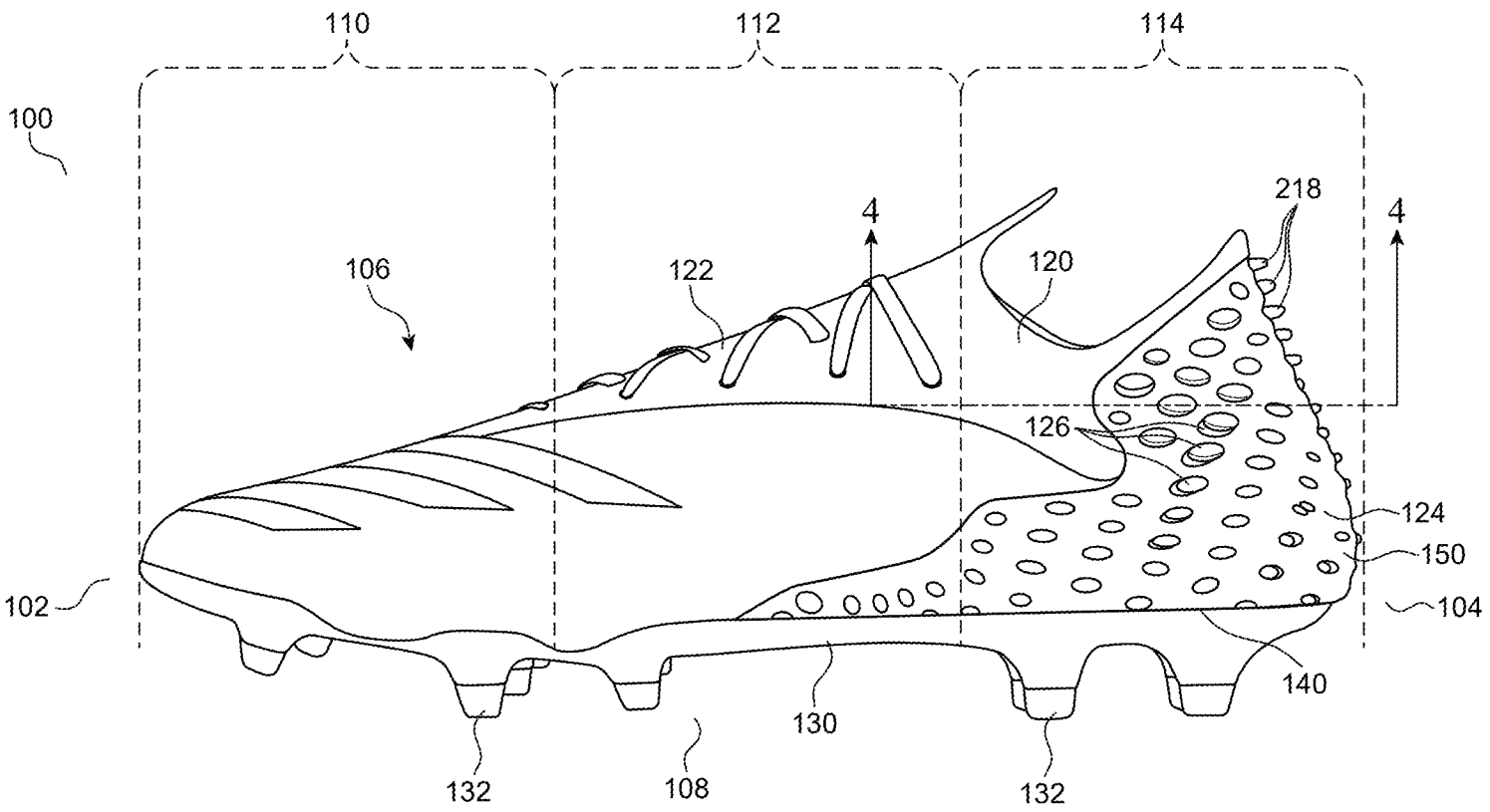
FIG. 1 shows a side view of an article of footwear according to some embodiments.

The present invention(s) will now be described in detail with reference to embodiments thereof as illustrated in the accompanying drawings. References to "some embodiments", "one embodiment", "an embodiment", "an exemplary embodiment", etc., indicate that the embodiment described can comprise a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The indefinite articles "a," "an," and "the" include plural referents unless clearly contradicted or the context clearly dictates otherwise.

The term "comprising" is an open-ended transitional phrase. A list of elements following the transitional phrase "comprising" is a non-exclusive list, such that elements in addition to those specifically recited in the list can also be present.

As used herein, unless specified otherwise, references to "first," "second," "third," "fourth," etc. are not intended to denote order, or that an earlier-numbered feature is required for a later-numbered feature. Also, unless specified otherwise, the use of "first," "second," "third," "fourth," etc. does not necessarily mean that the "first," "second," "third," "fourth," etc. features have different properties or values.

Articles of footwear, and components thereof, described herein can provide unique support, cushioning, and/or aesthetics. In particular embodiments, uppers described herein comprise a rigid cage configured to provide desired support to at least a portion of an article of footwear, for example a heel region or a midfoot region. The rigid cage can comprise openings configured to receive protrusions on a padding element. In some embodiments, characteristics of the openings can be based on foot scan data, which can facilitate targeted support and comfort characteristics for rigid cage.

Uppers described herein can also comprise a padding element designed to account for different foot contours and shapes. The padding elements can provide targeted cushioning and/or support to improve the fit of an upper on a wearer's foot. In particular embodiments, the padding element can comprise projections having interior and/or exterior protrusions with characteristics based on foot scan data, which can provide targeted support and comfort characteristics for the padding element.

Together, the padding element and rigid cage can interface with each other to provide desired support and/or cushioning characteristics. When assembled, the exterior protrusions of the padding element can extend into openings on the rigid cage. This interface between the padding element and rigid cage can allow the padding element to push through the openings, which can help achieve an even pressure distribution on a wearer's foot. This interface, along with characteristics of the interior and/or exterior protrusions on the padding element described herein, can achieve even pressure distribution and cushioning properties for various foot shapes and contours. The pressure distribution and cushioning created by the unique padding elements and rigid cages described herein can reduce or prevent discomfort for a wearer.

What is more, the padding element, the rigid cage, and the interface between the two as described herein can provide improved fit and lock down across various foot shapes (for example, heel shapes) while not hindering lock in on dynamic movements. The flexibility and cushion provided the padding element, and the rigidity provided by the rigid cage provide a unique combination of support, cushioning, fit, and lock in. This unique combination of features can provide a comfortable and supportive article of footwear for use in a variety of situations, including non-performance activities and performance activities, such as running or sport activities.

FIG. 1 shows an article of footwear 100 according to some embodiments. Article of footwear 100 can comprise an upper 120 coupled to a sole 130 along a bite line 140. Bite line 140 is an upper periphery of sole 130 at which upper 120 is joined to sole 130. Upper 120, and portions thereof, can be joined to sole 130 using any suitable attachment technique, including but not limited to, adhesive bonding, mechanical bonding, welding, heat bonding, stitching, or integral forming techniques such as molding or additive manufacturing, or a combination thereof.

In some embodiments, rigid cage 124 can be coupled to sole 130 along at least a portion of bite line 140. In some embodiments, rigid cage 124 can be manufactured separately from and attached to sole 130 (for example, by adhesive bonding, mechanical bonding, stitching, or welding) at bite line 140. In some embodiments, as shown for example in FIG. 3, rigid cage 124 and sole 130 can be integrally formed as a single piece. For example, rigid cage 124 and sole 130 can be integrally molded or additively manufactured as a single piece. In such embodiments, rigid cage 124 can be integrally formed with sole 130 at bite line 140.

Article of footwear 100 can comprise a forefoot end 102, a rearfoot end 104, a medial side 106, and a lateral side 108 opposite medial side 106. Also, as shown for example in FIG. 1, article of footwear 100 can comprise a forefoot portion 110, a midfoot portion 112, and a rearfoot portion 114. Portions 110, 112, and 114 are not intended to demarcate precise areas of article of footwear 100. Rather, portions 110, 112, and 114 are intended to represent general areas of article of footwear 100 that provide a frame of reference. Although portions 110, 112, and 114 apply generally to article of footwear 100, references to portions 110, 112, and 114 also can apply specifically to upper 120 or sole 130, or individual components of upper 120 or sole 130.

In some embodiments, rigid cage 124 can wrap around rearfoot portion 114 of an article of footwear 100 to form a heel cage 150. In some embodiments, rigid cage 124 can additionally or alternative wrap around forefoot portion 110 of article of footwear 100. In some embodiments, rigid cage 124 can wrap around forefoot portion 110, midfoot portion 112, and rearfoot portion 114 of article of footwear 100.

Upper 120 and sole 130 can be configured for a specific type of footwear, comprising, but not limited to, a cleat (e.g., a baseball cleat, a soccer cleat, or a football cleat), a basketball shoe, a running shoe, a hiking shoe, a water shoe, a training shoe, a fitness shoe, a dancing shoe, a biking shoe, a tennis shoe, a boot, a walking shoe, a casual shoe, or a dress shoe. In some embodiments, sole 130 can comprise traction elements, for example cleats 132 as shown in FIG. 1.

In some embodiments, upper 120 can comprise a textile layer 122. Textile layer 122 can be coupled to other components of footwear 100, for example, sole 130, a rigid cage 124, and/or a padding element 126, by any suitable attachment technique (for example, adhesive bonding, mechanical bonding, heat bonding, stitching, or a combination thereof). In some embodiments, textile layer 122 can comprise one or more lace structures for receiving a shoe lace. In some embodiments, textile layer 122 can be coupled to rigid cage 124 and padding element 126.

Figure 5:
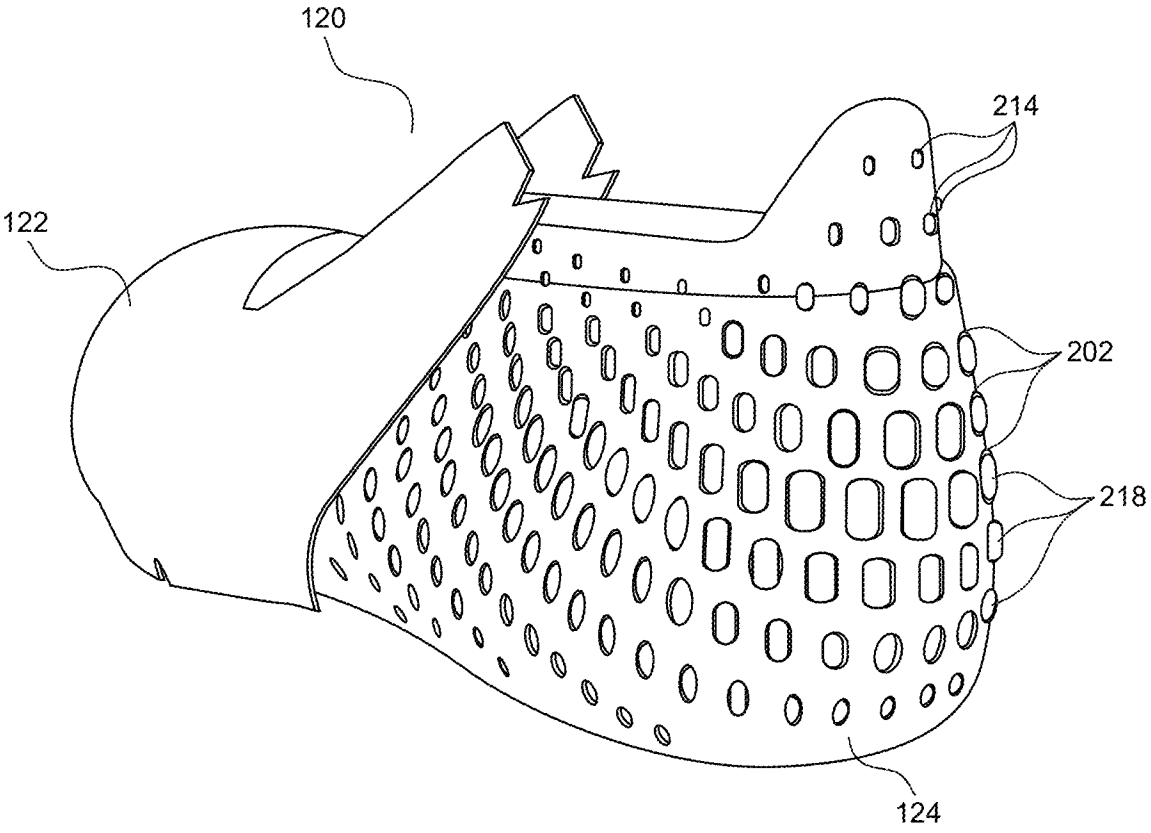
FIG. 5 shows a perspective view of an upper according to some embodiments.

In some embodiments, textile layer 122 can be coupled to an interior surface 222 of rigid cage 124 such that at least a portion of rigid cage 124 overlaps an exterior surface of textile layer 122. In some embodiments, textile layer 122 can be coupled to an exterior surface 223 of rigid cage 124 such that at least a portion of textile layer 122 overlaps exterior surface 223 of rigid cage 124. In some embodiments, at least a portion of textile layer 122 can be disposed between interior surface 222 of rigid cage 124 and an exterior surface 220 of padding element 126. In such embodiments, at least a portion of textile layer 122 can be coupled to interior surface 222 of rigid cage 124 and exterior surface 220 of padding element 126. In some embodiments, as shown for example in FIG. 5, textile layer 122 can be coupled to exterior surface 223 of rigid cage 124 and exterior surface 220 of padding element 126 such that at least a portion of textile layer 122 overlaps exterior surface 223 of rigid cage 124 and exterior surface 220 of padding element 126. In some embodiments, textile layer 122 can be coupled to interior surface 224 of padding element 126 such that at least a portion of padding element 126 overlaps an exterior surface of textile layer 122.

Suitable materials for textile layer 122 include, but are not limited to, a non-woven fabric, a woven fabric, knitted fabric material, natural leather, or synthetic leather. In some embodiments, textile layer 122, or a piece of material defining textile layer 122 can comprise a foam material. Exemplary textile materials for textile layer 122 comprise, but are not limited to, thermoplastic polyurethane (TPU), polyester, polyamide, polyethylene (PE), PE foam, polyurethane (PU) foam, nylon, ultra-high molecular weight polyethylene (for example, DYNEEMA® (a type of ultra-high molecular weight polyethylene)), carbon fiber, KEVLAR® (a type of para-aramid), synthetic spider silk, cotton, wool, natural or artificial silk, polyethersulfone (PES), ELASTAN® (a polyether-polyurea copolymer), or a blend of two or more of these materials. In some embodiments, textile layer 122, or a piece of material defining textile layer 122, can comprise a polymeric sheet or film, for example, a TPU sheet or film. In some embodiments, textile layer 122, or a piece of material defining textile layer 122, can comprise a mesh material.

Rigid cage 124 comprises a rigid material. Suitable rigid materials for rigid cage 124 include, but are not limited to, thermoplastic polyurethane (TPU), expanded polyurethane (EPU), ethylene-vinyl acetate (EVA), nylon, and fiber composite materials, for example carbon fiber and fiber glass composites. In some embodiments, rigid cage 124 can comprise a rigid material having a durometer Shore hardness of greater than or equal to 35D. In some embodiments, rigid cage 124 can comprise a rigid material having a durometer Shore hardness of greater than or equal to 60D. In some embodiments, rigid cage 124 can comprise a rigid material having a rigidity greater than the rigidity of the material of padding element 126. In some embodiments, rigid cage 124 can comprise a rigid material having a Shore hardness greater than the Shore hardness of the material of padding element 126.

Rigid cage 124 comprises a plurality of openings 202 formed in cage 124. Openings 202 are through openings extending from interior surface 222 of rigid cage 124 to exterior surface 223 of rigid cage 124. In some embodiments, openings 202 can be arranged in a regular, repeated pattern. In some embodiments, openings 202 can be arranged in straight lines. In some embodiments, openings 202 can be arranged along slanted lines or curved lines.

Upper 120 can also comprise padding element 126 disposed under rigid cage 124. In some embodiments, padding element 126 can be coupled to interior surface 222 of rigid cage 124. In some embodiments, exterior surface 220 of padding element 126 can be coupled to interior surface 222 of rigid cage 124. Padding element 126 can be coupled to interior surface 222 of rigid cage 124 using any suitable attachment technique, including but not limited to, adhesive bonding, mechanical bonding, heat bonding, stitching, or a combination thereof.

Padding element 126 can comprise a soft material. In some embodiments, padding element 126 can comprise an elastomeric foam or an elastomeric polymer. Suitable soft materials for padding element 126 include, but are not limited to, a polyurethane, ethyl vinyl acetate (EVA), a polyethylene, a rubber (for example, styrene butadiene rubber), a latex, Neoprene (polychloroprene), a polyether, and a foam comprising any of these materials. In some embodiments, padding element 126 can comprise a soft material having a durometer Shore hardness of less than or equal to 40C. In some embodiments, padding element 126 can comprise a soft material having a durometer Shore hardness of less than or equal to 40C and greater than or equal to 15C.

Figure 2:
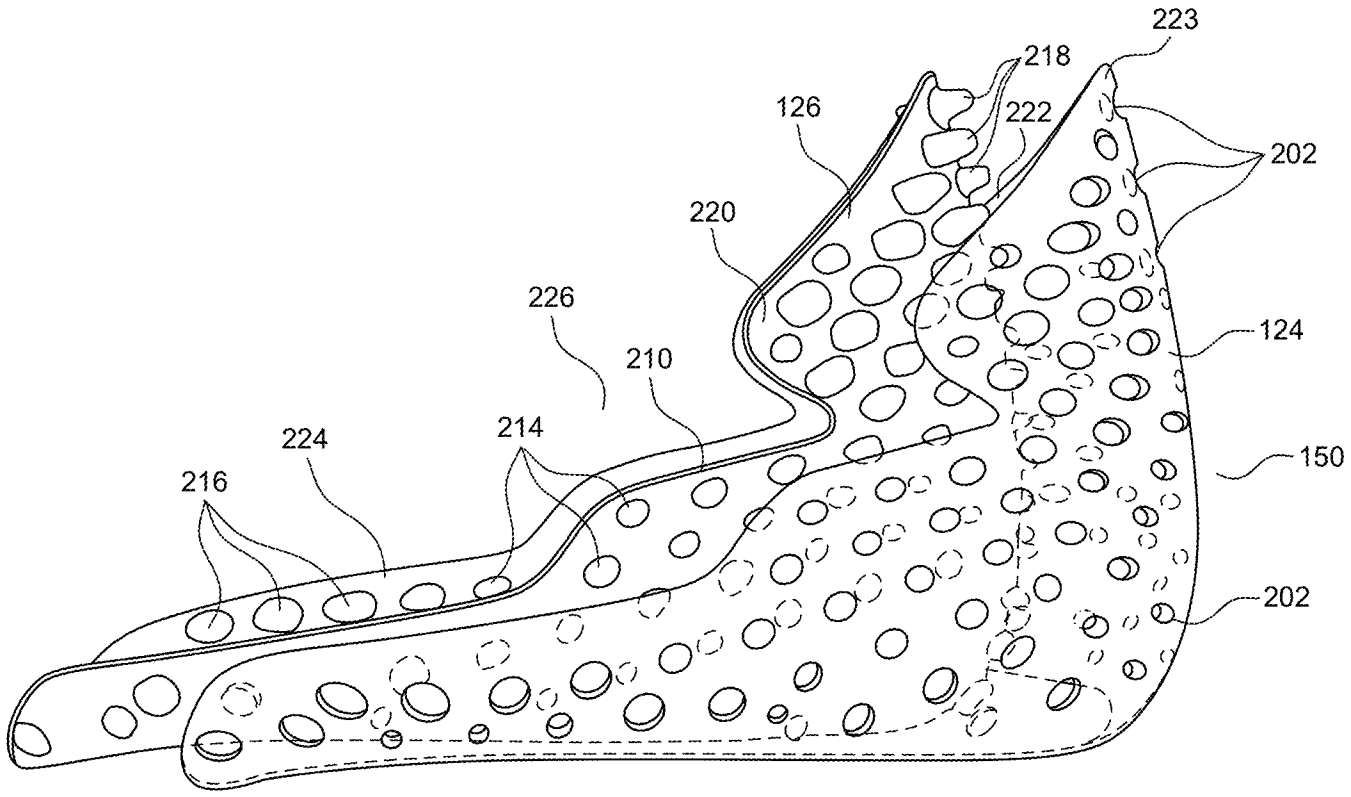
FIG. 2 shows a rigid cage and padding element according to some embodiments.
Figure 3:
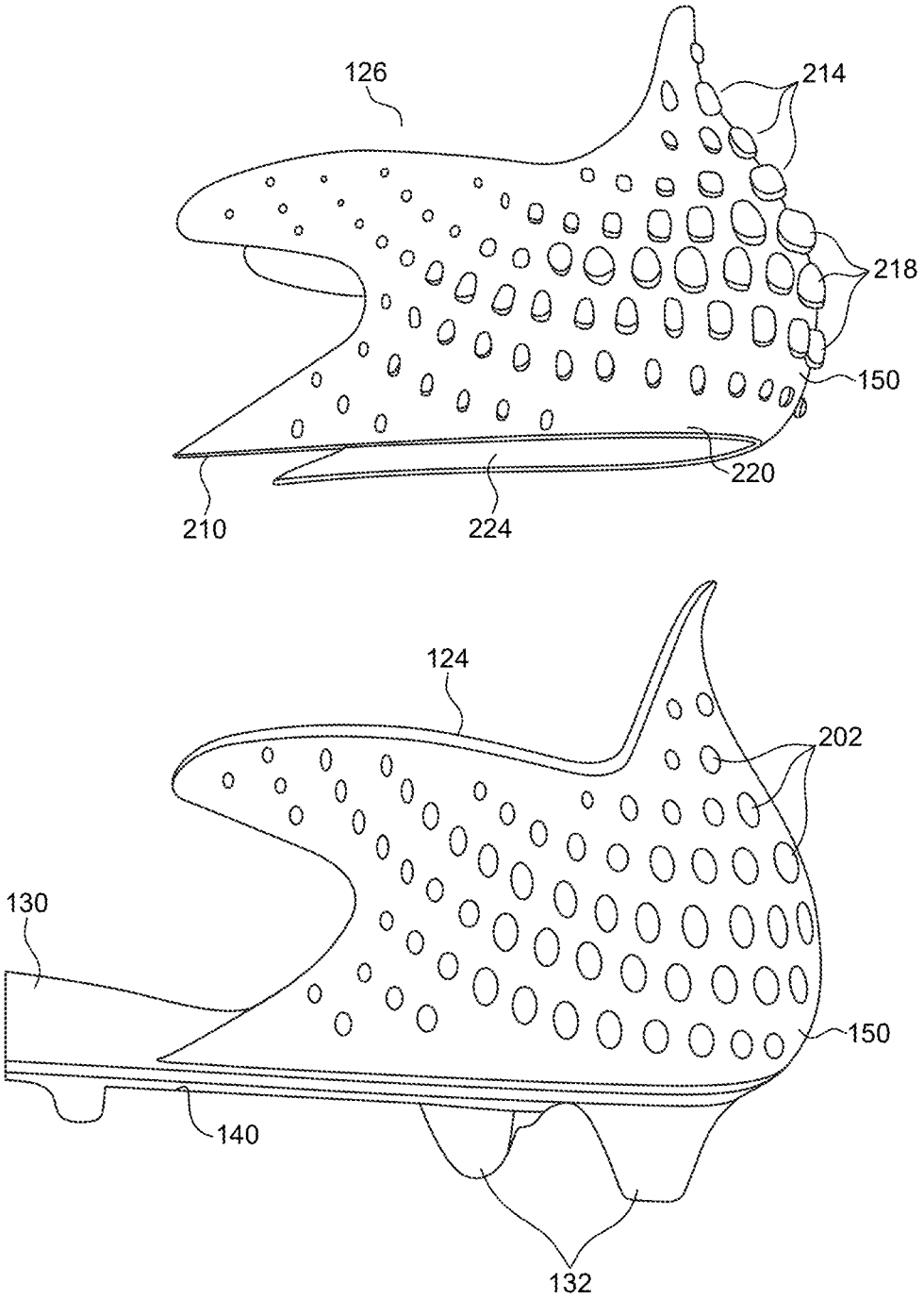
FIG. 3 shows a rigid cage and padding element according to some embodiments.

As shown for example in FIGS. 2 and 3, padding element 126 can comprise a base layer 210 and a plurality of projections 214 extending from base layer 210. Base layer 210 can comprise exterior surface 220 facing an interior surface 222 of rigid cage 124, and interior surface 224 disposed opposite exterior surface 220. Projections 214 can comprise a plurality of interior protrusions 216 extending from interior surface 224 of base layer 210, a plurality of exterior protrusions 218 extending from exterior surface 220 of base layer 210, or both interior protrusions 216 and exterior protrusions 218.

In some embodiments, base layer 210 and projections 214 can be integrally formed as a single piece. For example, in some embodiments, base layer 210 and projections 214 can be integrally molded or additively manufactured as a single piece. In some embodiments, projections 214, or portions thereof, including interior protrusions 216 and exterior protrusions 218, can be manufactured separately from and attached to base layer 210 (for example, by adhesive bonding, mechanical bonding, stitching, welding).

As shown for example in FIGS. 1 and 4A-5, in some embodiments, padding element 126 can be assembled with rigid cage 124 such that exterior protrusions 218 of the plurality of projections 214 are disposed within corresponding openings 202 formed in rigid cage 124. In some embodiments, when padding element 126 is assembled with rigid cage 124, at least some of exterior protrusions 218 can extend outward from openings 202 of rigid cage 124. In such embodiments, as shown for example in FIGS. 6, a top surface 619 of exterior protrusions 218 can be disposed outward from exterior surface 223 of rigid cage 124.

In some embodiments, when padding element 126 is assembled with rigid cage 124, some or all of exterior protrusions 218 can be disposed within openings 202 and not extend through openings 202. In such embodiments, a top surface 619 of exterior protrusions 218 can be disposed inward from exterior surface 223 of rigid cage 124.

In some embodiments, when padding element 126 is assembled with rigid cage 124, some or all of exterior protrusions 218 can be flush with openings 202 and not extend outward from openings 202. In such embodiments, a top surface 619 of exterior protrusions 218 can be flush with exterior surface 223 of rigid cage 124.

In some embodiments the arrangement of a plurality of projections 214 can be identical on both sides of base layer 210. In such embodiments, respective interior protrusions 216 of projections 214 on interior surface 224 can correspond in position to respective exterior protrusions 218 on exterior surface 220. In some embodiments, the arrangement of interior protrusions 216 on interior surface 224 can differ relative to the arrangement of exterior protrusions 218 on exterior surface 220.

Figure 6:
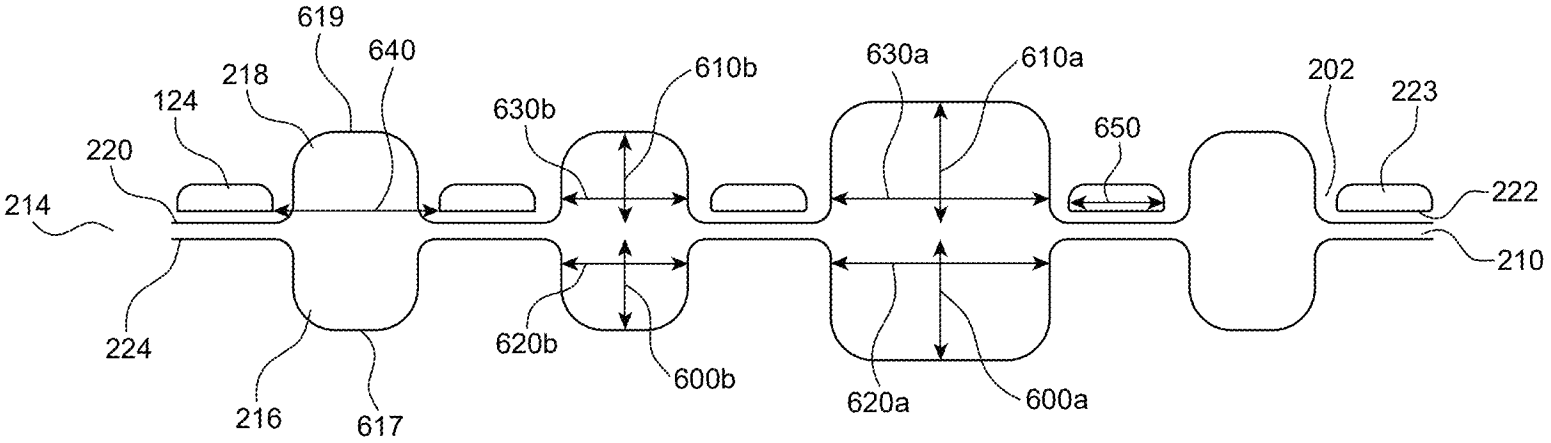
FIG. 6 shows protrusions and openings in a rigid cage according to some embodiments.

In some embodiments, as shown for example in FIG. 6, a height 600 of respective interior protrusions 216, measured from interior surface 224 of base layer 210 to top surface 617 of a protrusion 216, can vary on padding element 126. In some embodiments, an effective dimeter 620 of respective interior protrusions 216 can vary on padding element 126. In some embodiments, height 600 and effective dimeter 620 of respective interior protrusions 216 can vary on padding element 126. In some embodiments, height 600 of respective interior protrusions 216 can vary based on a foot scan map, for example foot scan map 700 described herein. In some embodiments, effective diameter 620 of respective interior protrusions 216 can vary based on a foot scan map, for example map 700 described herein. In some embodiments, both height 600 and effective diameter 620 of respective interior protrusions 216 can vary based on a foot scan map, for example map 700 described herein.

In some embodiments, as shown for example in FIG. 6, a height 610 of respective exterior protrusions 218, measured from exterior surface 220 of base layer 210 to top surface 619 of a protrusion 218, can vary on padding element 126. In some embodiments, an effective dimeter 630 of respective exterior protrusions 218 can vary on padding element 126. In some embodiments, height 610 and effective dimeter 630 of respective exterior protrusions 218 can vary on padding element 126. In some embodiments, height 610 of respective exterior protrusions 218 can vary based on a foot scan map, for example map 700 described herein. In some embodiments, effective diameter 630 of respective exterior protrusions 218 can vary based on a foot scan map, for example map 700 described herein. In some embodiments, both height 610 and effective diameter 630 of respective exterior protrusions 218 can vary based on a foot scan map, for example map 700 described herein.

The term "effective diameter" is used to describe the size of a component (for example, a protrusion or opening), but this term should not be interpreted as requiring the component to have a circular diameter or shape. Instead, the component can have a non-circular shape, and in such embodiments, the term "effective diameter" is intended to refer to the maximum cross-sectional dimension of the shape. For example, the "effective diameter" of a component having an elliptical cross-sectional shape would be the length of the major axis of the elliptical shape. For a component having an effective diameter that varies along its depth or height, the effective diameter is the largest effective diameter.

In some embodiments, interior protrusions 216 can each comprise a height 600 ranging from 1 mm (millimeters) to 15 mm. In some embodiments, interior protrusions 216 can each comprise a height 600 ranging from 1 mm to 10 mm. In some embodiments, interior protrusions 216 can each comprise a height 600 ranging from 1 mm to 6 mm. In some embodiments, interior protrusions 216 can each comprise a height 600 ranging from 2 mm to 4 mm.

In some embodiments, a plurality of interior protrusions 216 can comprise a height 600, and the height 600 of respective interior protrusions (for example, first height 600*a* and second height 600*b*) can vary on interior surface 224 of base layer 210. In some embodiments, a variation between the height 600 of a shortest interior protrusion 216 (for example, height 600*b*) and the height 600 of a tallest interior protrusion 216 (for example, height 600*a*) can be at least 12 mm. In such embodiments, height 600*a* can be at least 12 mm greater than height 600*b*. In some embodiments, a variation between the height 600 of a shortest interior protrusion 216 (for example, height 600*b*) and the height 600 of a tallest interior protrusion 216 (for example, height 600*a*) can be at least 8 mm. In such embodiments, height 600*a* can be at least 8 mm greater than height 600*b*. In some embodiments, a variation between the height 600 of a shortest interior protrusion 216 (for example, height 600*b*) and the height 600 of a tallest interior protrusion 216 (for example, height 600*a*) can be at least 2 mm. In such embodiments, height 600*a* can be at least 2 mm greater than height 600*b*.

In some embodiments, height 600 of respective interior protrusions 216 can vary based on data from a foot scan map, for example map 700, such that the height of respective interior protrusions 216 (for example, first height 600*a* and second height 600*b*) varies based on data from the foot scan map.

In some embodiments, exterior protrusions 218 can each comprise a height 610 ranging from 1 mm to 15 mm. In some embodiments, exterior protrusions 218 can each comprise a height 610 ranging from 1 mm to 10 mm. In some embodiments, exterior protrusions 218 can each comprise a height 610 ranging from 1 mm to 6 mm. In some embodiments, exterior protrusions 218 can each comprise a height 610 ranging from 2 mm to 4 mm.

In some embodiments, a plurality of exterior protrusions 218 can comprise a height 610, and the height 610 of respective interior protrusions (for example, first height 610*a* and second height 610*b*) can vary on exterior surface 220 of base layer 210. In some embodiments, a variation between the height 610 of a shortest exterior protrusion 218 (for example, height 610*b*) and the height 610 of a tallest exterior protrusion 218 (for example, height 610*a*) can be at least 12 mm. In such embodiments, height 610*a* can be at least 12 mm greater than height 610*b*. In some embodiments, a variation between the height 610 of a shortest exterior protrusion 218 (for example, height 610*b*) and the height 610 of a tallest exterior protrusion 218 (for example, height 610*a*) can be at least 8 mm. In such embodiments, height 610*a* can be at least 8 mm greater than height 610*b*. In some embodiments, a variation between the height 610 of a shortest exterior protrusion 218 (for example, height 610*b*) and the height 610 of a tallest exterior protrusion 218 (for example, height 610*a*) can be at least 2 mm. In such embodiments, height 610*a* can be at least 2 mm greater than height 610*b*.

In some embodiments, height 610 of respective exterior protrusions 218 can vary based on data from a foot scan map, for example map 700, such that the height of respective exterior protrusions 218 (for example, first height 610*a* and second height 610*b*) varies based on data from the foot scan map.

In some embodiments, a first plurality of exterior protrusions 218 can comprise a height 610 that extends outward from exterior surface 223 of rigid cage 124, and a second plurality of exterior protrusions 218 can comprise a height 610 disposed below exterior surface 223 of rigid cage 124. In such embodiments, a top surface 619 of the first plurality of exterior protrusions 218 can be disposed outward from exterior surface 223 of rigid cage 124, and top surface 619 of the second plurality of exterior protrusions 218 can be disposed inward from exterior surface 223 of rigid cage 124.

In some embodiments, interior protrusions 216 can each comprise an effective diameter 620 ranging from 2 mm to 30 mm. In some embodiments, interior protrusions 216 can each comprise an effective diameter 620 ranging from 5 mm to 30 mm, from 10 mm to 30 mm, from 5 mm to 25 mm, or from 5 mm to 20 mm.

In some embodiments, a plurality of interior protrusions 216 can comprise an effective diameter 620, and the effective diameter 620 of respective interior protrusions 216 (for example, first effective diameter 620*a* and second effective diameter 620*b*) can vary on interior surface 224 of base layer 210. In some embodiments, a variation between the effective diameter 620 of a narrowest interior protrusion 216 (for example, effective diameter 620*b*) and the effective diameter 620 of a widest interior protrusion 216 (for example, effective diameter 620*a*) can be at least 10 mm. In such embodiments, effective diameter 620*a* can be at least 10 mm greater than effective diameter 620*b*. In some embodiments, a variation between the effective diameter 620 of a narrowest interior protrusion 216 (for example, effective diameter 620*b*) and the effective diameter 620 of a widest interior protrusion 216 (for example, effective diameter 620*a*) can be at least 2 mm. In such embodiments, effective diameter 620*a* can be at least 2 mm greater than effective diameter 620*b*.

In some embodiments, effective diameter 620 of respective interior protrusions 216 can vary based on data from a foot scan map, for example map 700, such that the effective diameter of respective interior protrusions 216 (for example, first effective diameter 620*a* and second effective diameter 620*b*) varies based on data from the foot scan map.

In some embodiments, exterior protrusions 218 can each comprise an effective diameter 630 ranging from 2 mm to 30 mm. In some embodiments, exterior protrusions 218 can each comprise an effective diameter 630 ranging from 5 mm to 30 mm, from 10 mm to 30 mm, from 5 mm to 25 mm, or from 5 mm to 20 mm.

In some embodiments, a plurality of exterior protrusions 218 can comprise an effective diameter 630, and the effective diameter 630 of respective exterior protrusions 218 (for example, first effective diameter 630*a* and second effective diameter 630*b*) can vary on exterior surface 220 of base layer 210. In some embodiments, a variation between the effective diameter 630 of a narrowest exterior protrusion 218 (for example, effective diameter 630*b*) and the effective diameter 630 of a widest exterior protrusion 218 (for example, effective diameter 630*a*) can be at least 10 mm. In such embodiments, effective diameter 630*a* can be at least 10 mm greater than effective diameter 630*b*. In some embodiments, a variation between the effective diameter 630 of a narrowest exterior protrusion 218 (for example, effective diameter 630*b*) and the effective diameter 630 of a widest exterior protrusion 218 (for example, effective diameter 630*a*) can be at least 2 mm. In such embodiments, effective diameter 630*a* can be at least 2 mm greater than effective diameter 630*b*.

In some embodiments, the effective diameter 630 of respective exterior protrusions 218 can vary based on data from a foot scan map, for example map 700, such that the effective diameter of respective exterior protrusions 218 (for example, first effective diameter 630*a* and second effective diameter 630*b*) varies based on data from the foot scan map.

In some embodiments, openings 202 in rigid cage 124 can comprise an effective diameter 640 ranging from 1 mm to 30 mm. In some embodiments, openings 202 in rigid cage 124 can comprise an effective diameter 640 ranging from 2 mm to 30 mm, from 5 mm to 30, from 10 mm to 30 mm, from 1 mm to 25 mm, or from 1 mm to 20 mm. In some embodiments, a plurality of openings 202 can comprise an effective diameter 640 and the effective diameter 640 of respective openings 202 can vary on rigid cage 124. In some embodiments, a variation between the effective diameter 640 of a narrowest opening 202 and the effective diameter 640 of a widest opening 202 can be at least 2 mm.

In some embodiments, effective diameter 640 of respective openings 202 can vary based on data from a foot scan map, for example map 700, such that effective diameter 640 of respective openings 202 varies based on data from the foot scan map.

In some embodiments, a plurality of projections 214 can be sized and shaped identically on either side of base layer 210. In such embodiments, interior protrusions 216 on interior surface 224 can be identical in height and effective diameter to corresponding exterior protrusions 218 on exterior surface 220. In some embodiments, a plurality of interior protrusions 216 can have different heights and/or effective diameters from those of corresponding exterior protrusions 218.

In some embodiments, adjacent exterior protrusions 218 can be positioned at least 3 mm from one another. In such embodiments, a width 650 between adjacent openings 202 can be at least 3 mm. Sufficient spacing between adjacent exterior protrusions 218 and openings 202 can serve to ensure rigid cage 124 provides desired strength and support for a wearer.

Figure 4B:
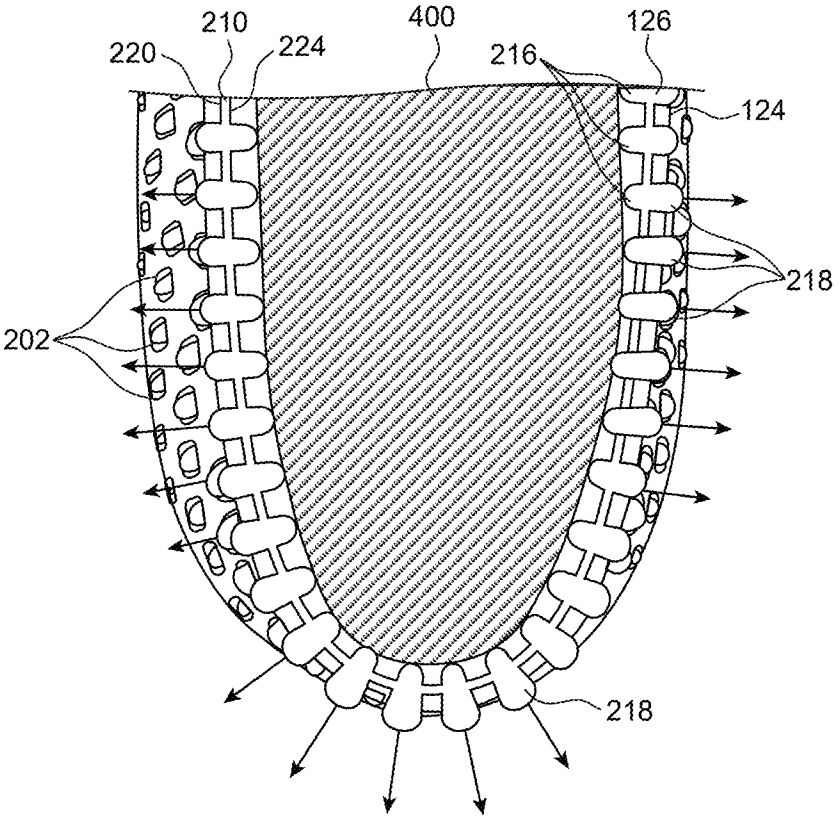
FIG. 4B shows the crow-sectional view of FIG. 4A when the article of footwear is in use.
Figure 4A:
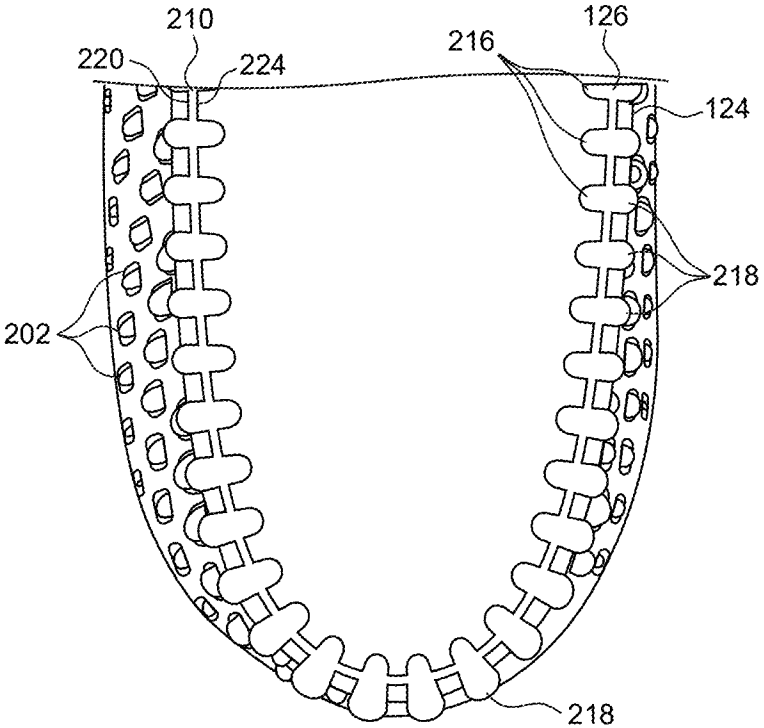
FIG. 4A shows a cross-sectional view of FIG. 1 along line 4-4, showing a rearfoot portion of an article of footwear according to some embodiments.

As shown for example in FIG. 4B, when article of footwear 100 is in use, a wearer's foot 400 can make contact with at least some of interior protrusions 216, causing at least some of projections 214 to be displaced outward relative to foot 400. And by displacing at least some of projections 214 outward, exterior protrusions 218 can be forced to extend further from openings 202 than when the article of footwear 100 is not in use.

It is to be appreciated that the shape of openings 202, interior protrusions 216, and exterior protrusions 218 can vary. As shown for example in FIG. 2, in some embodiments openings 202, interior protrusions 216, and exterior protrusions 218 can comprise an ovoid shape. In some embodiments, openings 202, interior protrusions 216, and exterior protrusions 218 can comprise a cylindrical shape, a conical shape, a tubular shape, a hemispherical shape, a cubic shape, a rectangular shape, a triangular shape, or a hexagonal shape.

In some embodiments, upper 120 and projections 214 can be arranged, shaped, and/or sized to provide a desired combination of cushioning, comfort, support, and/or stability to article of footwear 100 based a wearer's desired fit or anatomical needs (for example, the contour of the wearer's foot).

Figure 7:
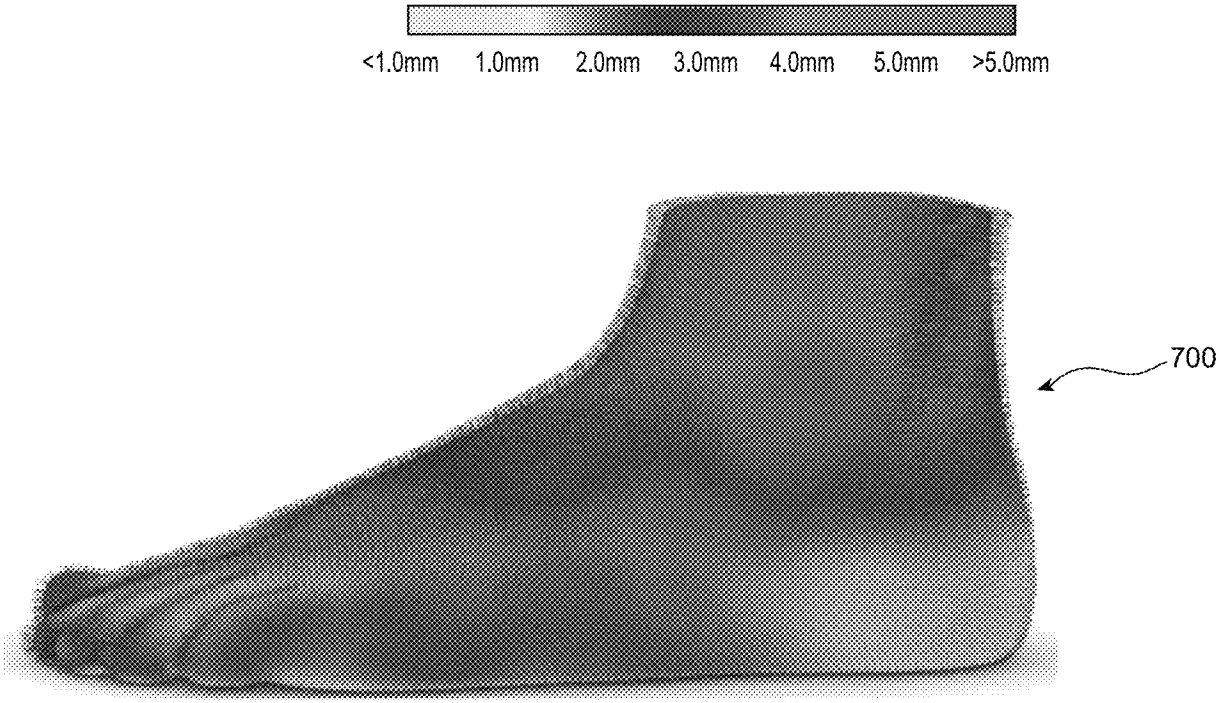
FIG. 7 shows a foot scan map according to some embodiments.

In some embodiments, the arrangement and dimensions (shape and size) of projections 214 can be based on data from a foot scan map 700. In some embodiments, the data of foot scan map 700 can comprise standard deviation values for variations in foot contour measured for a group of individuals. In some embodiments, the standard deviation values for variations in foot contour can be variations in a lateral dimension perpendicular to the perimeter foot contour for each individual in the group of individuals. For example, as illustrated in FIG. 7, the standard deviation values for foot scan map 700 are largest in upper ankle and toe regions of the map, while the standard deviation values are smallest in the bottom heel area.

Standard deviation values for variations in foot contour measured for a group of individuals in map 700 are indicative of how much variation is present in foot shape for the group of individuals. For example, map 700 shows that the shape of the individuals' upper ankle region had the most variation, meaning that the individuals' upper ankles had significantly different shapes and contours. As another example, map 700 shows that the shape of the individuals' bottom heel region had the lowest variation, meaning that the shape and contour of the individuals' bottom heel region was most consistent. In other words, foot scan map 700 can show anatomical variance in a group of individuals, for example in the structure and positioning of the individuals' ankles, Achilles' heels, toes, etc.

A foot scan map 700 can be created by (i) scanning the feet of a group of individuals and using a computer program to align each scan at a particular point (for example, transversally and at the heel points) and (ii) calculating the standard deviation values for variations in foot contour at various points on the aligned scans. The foot scans can be collected using, for example, a Tiger 3D CAD/CAM Scanner system, and modeling software such as GRASSHOPPER™ and RHINO® 3D can be used to align the scans and calculate the standard deviations in contour.

In some embodiments, foot scan map 700 can comprise standard deviation values for variations in foot contour measured for a group of at least 50 individuals. In some embodiments, foot scan map 700 comprise standard deviation values for variations in foot contour measured for a group of individuals having a similar biometric characteristic. Exemplary biometric characteristics include, but are not limited to, a heel striker, a midfoot striker, a forefoot striker, a pronator, a supinator, a gender, a shoe size range, a height range, and a weight range.

FIGS. 8A-8E illustrate a method of making an article of footwear 100 according to some embodiments. Unless stated otherwise, the steps of the method need not be performed in the order set forth herein. Additionally, unless specified otherwise, the steps need not be performed sequentially. The steps can be performed in a different order or simultaneously. As one example, steps 802 and 803 can be performed simultaneously.

Figure 8C:
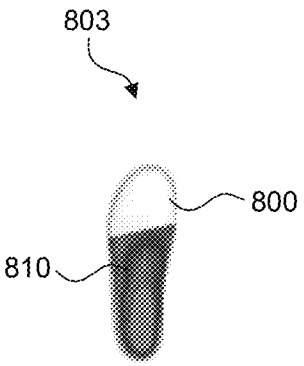
FIGS. 8A-8E illustrate a method according to some embodiments.
Figure 8B:
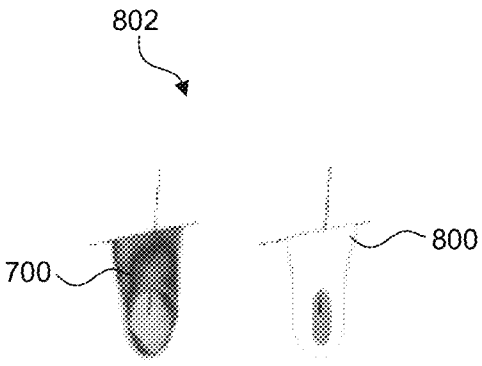
Figure 8A:
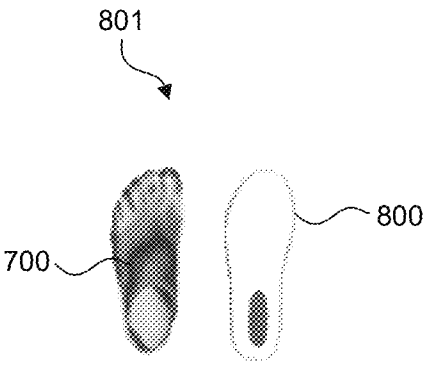

First, in step 801 illustrated in FIG. 8A, the method can comprise obtaining a foot scan map (for example, map 700) comprising standard deviation values for variations in foot contour measured for a group of individuals. Step 801 can also comprise obtaining a three-dimensional rendering of a virtual shoe last 800. The virtual shoe last 800 can be, for example, a virtual last for a standard shoe size or shoe size range.

In step 802 illustrated in FIG. 8B, a portion of map 700 can be selected to isolate a partial region of the map corresponding to a region on footwear 100. For example, map 700 can be sectioned to isolate all or a portion of forefoot portion 110, midfoot portion 112, rearfoot portion 114 of footwear 100, or a combination thereof. In some embodiments, virtual last 800 can also be similarly sectioned in step 802.

In step 803 illustrated in FIG. 8C, the selected portion 810 of map 700 can be mapped onto virtual last 800. The mapping in step 803 can conform portion 810 to the geometry of virtual last 800. In some embodiments, method 800 may not include step 802 and the entirety of map 700 can be mapped onto virtual last 800 in step 803.

Figure 8D:
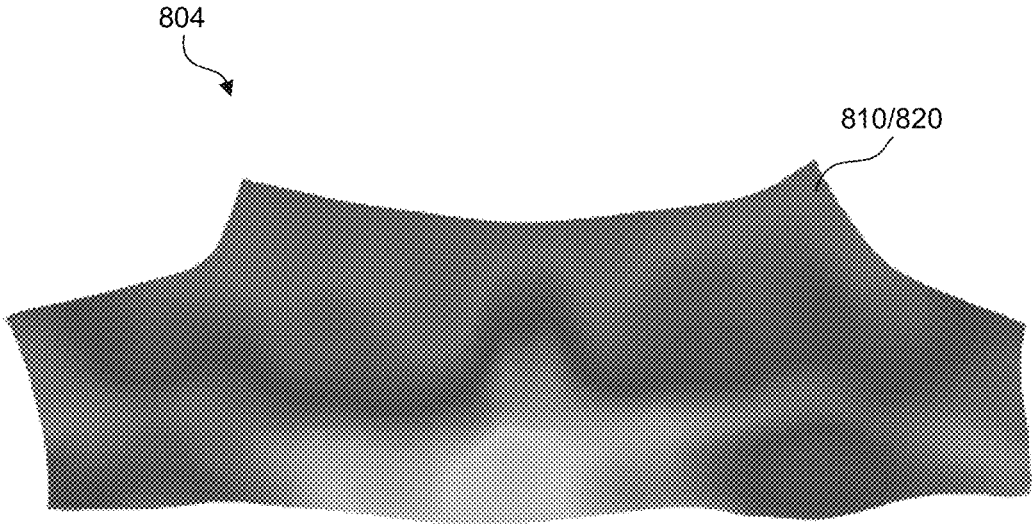

In some embodiments, after step 803, portion 810 can be a flattened into a flat map 820 as shown in step 804 illustrated in FIG. 8D. In some embodiments, the method may not include step 804.

Figure 8E:
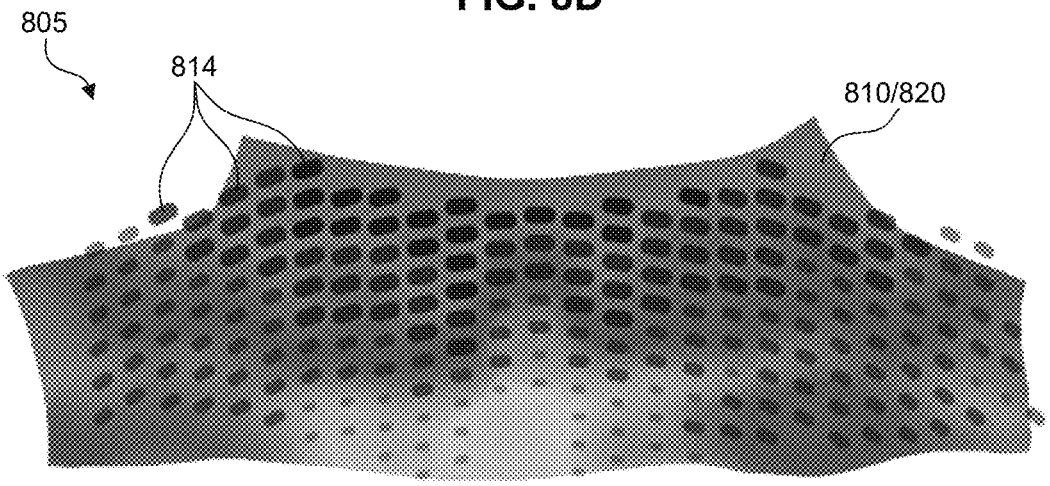

In step 805 illustrated in FIG. 8E, graphical projections 814 can be populated on flat map 820. In embodiments not including step 804, the graphical projections 814 can be populated on selected portion 810 after step 803.

Graphical projections 814 can represent the arrangement, size, and shape of projections 214 on padding element 126. Graphical projections 814 can be populated using, for example, graphics software, such as Vectoraster, ADOBE ILLUSTRATOR®, Blender, or Gravity Sketch software. In some embodiments, modeling software such as GRASSHOPPER™ and RHINO® 3D can additionally or alternately be used. Various design constraints, for example, a shape parameter, a size parameter, a material parameter, or a combination therefore can be input into the software used to populate the graphical projections 814. The software can comprise an algorithm that selects the arrangement, size, and shape of projections 814 based on at least the standard deviation values from map 700 and the inputted design constraints. In some embodiments, at least one of the density, size (height), and shape (effective diameter) of projections 814 can increase as the standard deviation values from map 700 increase.

After populating projections 814, padding element 126 comprising base layer 210 and projections 214 can be formed based on at least flat map 820 (or portion 810) and projections 814. The arrangement, size, and shape of projections 214 (including the arrangement, size, and shape of interior protrusions 216 and/or exterior protrusions 218) can be based on projections 814.

In some embodiments, at least one of height 600 or effective diameter 620 of respective interior protrusions 216 can vary based on the standard deviation values from map 700. For example, at least one of height 600 and effective diameter 620 of respective interior protrusions 216 can increase as the standard deviation values from map 700 increase. In such embodiments, the height 600 and/or effective diameter 620 of respective interior protrusions 216 can be based on corresponding projections 814 populated in step 805.

In some embodiments, at least one of height 610 or effective diameter 630 of respective exterior protrusions 218 can vary based on the standard deviation values from map 700. For example, at least one of height 610 and effective diameter 630 of respective exterior protrusions 218 can increase as the standard deviation values from map 700 increase. In such embodiments, the height 610 and/or effective diameter 630 of respective exterior protrusions 218 can be based on corresponding projections 814 populated in step 805.

In some embodiments, the perimeter size and shape of base layer 210 can be based on the size and shape of flat map 820, or portion 810.

After forming padding element 126 based on a foot scan map (for example, map 700), padding element 126 can be assembled with rigid cage 124 for footwear 100 such that exterior protrusions 218 of the plurality of projections 214 are disposed within corresponding openings 202 formed in rigid cage 124.

As shown in FIGS. 1-5, in some embodiments, rigid cage 124 can wrap around rearfoot portion 114 of an article of footwear 100 to form a heel cage 150. That said, rigid cage 124 and padding element 126 can be disposed in other areas of an article of footwear to provide desired support and padding to those areas. In some embodiments, rigid cage 124 and padding element 126 can be any of the cages or padding elements illustrated in FIGS. 9-13. In some embodiments, an article of footwear can comprise a plurality of rigid cages and padding elements, for example, an article of footwear can comprise a plurality of rigid cages 124, 924, 1024, 1124, 1224, and 1324, and a plurality of the padding elements 126, 926, 1026, 1126, 1226, and 1326. As a non-limiting example, an article of footwear can comprise rigid cage 124 and padding element 126, and rigid cage 924 and padding element 926.

Figure 9:
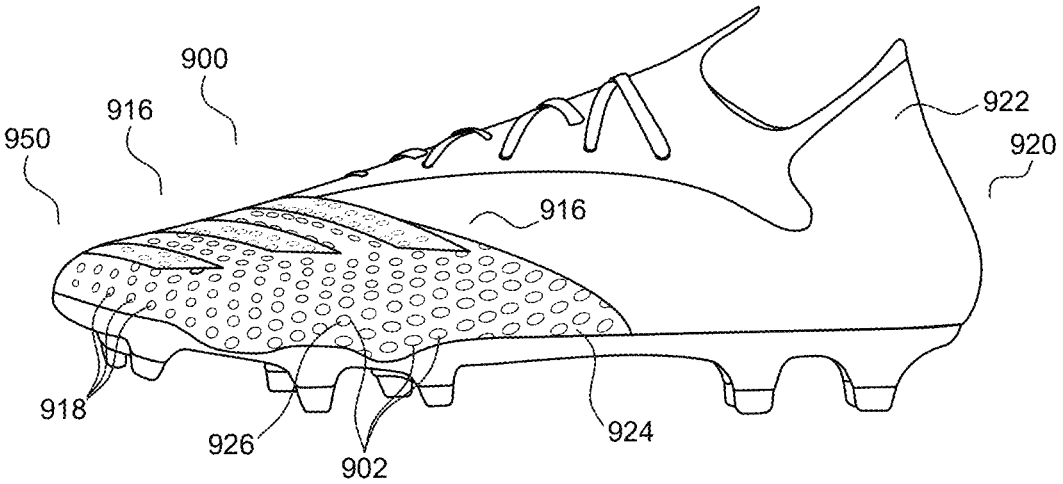
FIG. 9 shows a side view of an article of footwear according to some embodiments.

In some embodiments, as shown in FIG. 9, a rigid cage 924 can wrap around a vamp portion 916 of an article of footwear 900 to form a vamp cage 950. In such embodiments, an upper 920 of footwear 900 can comprise a textile layer 922 that is coupled by an attachment process (for example, adhesive bonding or stitching) to rigid cage 924, a padding element 926, or both. Rigid cage 924 can be the same as or similar to rigid cage 124. Padding element 926 can be the same as or similar to padding element 126. For example, padding element 926 can comprise a plurality of protrusions 918 disposed within, extending through, or varyingly disposed within and extending through a plurality of openings 902 on rigid cage 924. Further, textile layer 922 can be the same as or similar to textile layer 122.

Figure 10:
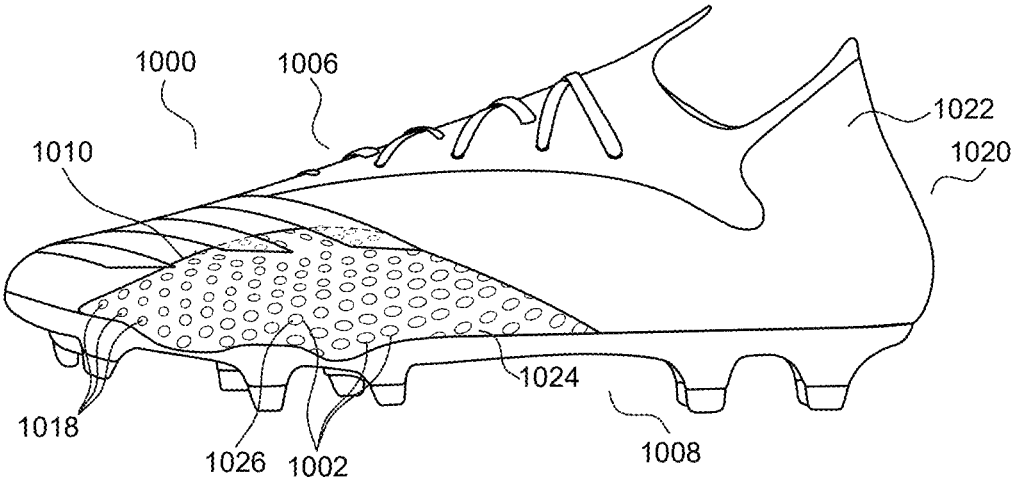
FIG. 10 shows a side view of an article of footwear according to some embodiments.

In some embodiments, as shown in FIG. 10, a rigid cage 1024 can wrap around a forefoot portion 1010 of an article of footwear 1000 to form a forefoot cage 1050. In some embodiments, forefoot cage 1050 can wrap around a lateral side 1008 of footwear 1000 as shown in FIG. 10. In some embodiments, forefoot cage 1050 can additional or alternatively be similarly wrapped around a medial side 1006 of footwear 1000. In such embodiments, an upper 1020 of footwear 1000 can comprise a textile layer 1022 that is coupled by an attachment process (for example, adhesive bonding or stitching) to rigid cage 1024, a padding element 1026, or both. Rigid cage 1024 can be the same as or similar to rigid cage 124. Padding element 1026 can be the same as or similar to padding element 126. For example, padding element 1026 can comprise a plurality of protrusions 1018 disposed within, extending through, or varyingly disposed within and extending through a plurality of openings 1002 on rigid cage 1024. Further, textile layer 1022 can be the same as or similar to textile layer 122.

Figure 11:
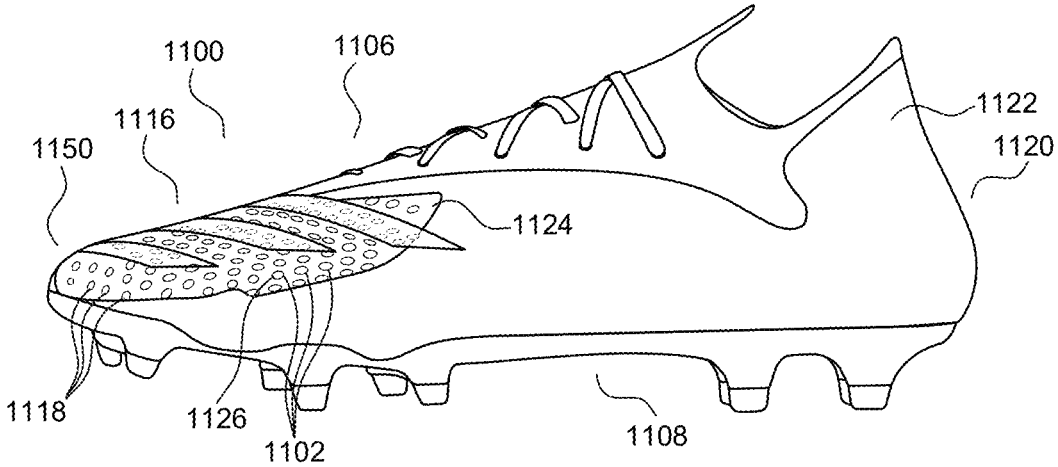
FIG. 11 shows a side view of an article of footwear according to some embodiments.

In some embodiments, as shown in FIG. 11, a rigid cage 1124 can wrap around a medial side 1106 of a vamp portion 1116 of an article of footwear 1100 to form a medial vamp cage 1150. In some embodiments, rigid cage 1124 can instead wrap around a lateral side 1106 of a vamp portion 1116 of article of footwear 1100 to form a lateral vamp cage. In such embodiments, an upper 1120 of footwear 1100 can comprise a textile layer 1122 that is coupled by an attachment process (e.g., adhesive bonding or stitching) to rigid cage 1124, a padding element 1126, or both. Rigid cage 1124 can be the same as or similar to rigid cage 124. Padding element 1126 can be the same as or similar to padding element 126. For example, padding element 1126 can comprise a plurality of projections 1118 disposed within, extending through, or varyingly disposed within and extending through a plurality of openings 1102 on rigid cage 1124. Further, textile layer 1122 can be the same as or similar to textile layer 122.

Figure 12:
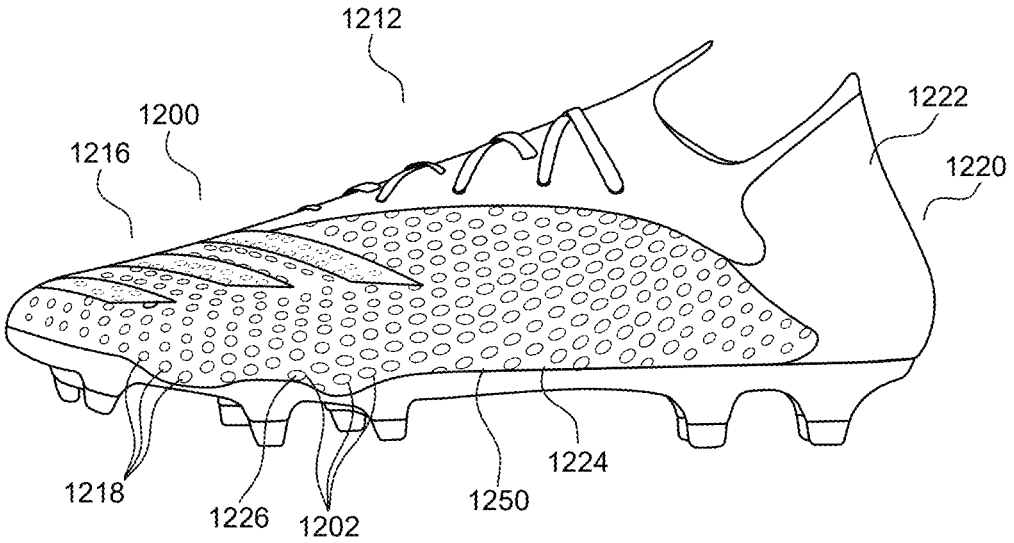
FIG. 12 shows a side view of an article of footwear according to some embodiments.

In some embodiments, as shown in FIG. 12, a rigid cage 1224 can wrap around both a vamp portion 1216 and a midfoot portion 1212 of an article of footwear 1200 to form a toc and midfoot cage 1250. In such embodiments, an upper 1220 of footwear 1200 can comprise a textile layer 1222 that is coupled by an attachment process (e.g., adhesive bonding or stitching) to rigid cage 1224, a padding element 1226, or both. Rigid cage 1224 can be the same as or similar to rigid cage 124. Padding element 1226 can be the same as or similar to padding element 126. For example, padding element 1226 can comprise a plurality of projections 1218 disposed within, extending through, or varyingly disposed within and extending through a plurality of openings 1202 formed in rigid cage 1224. Further, textile layer 1222 can be the same as or similar to textile layer 122.

Figure 13:
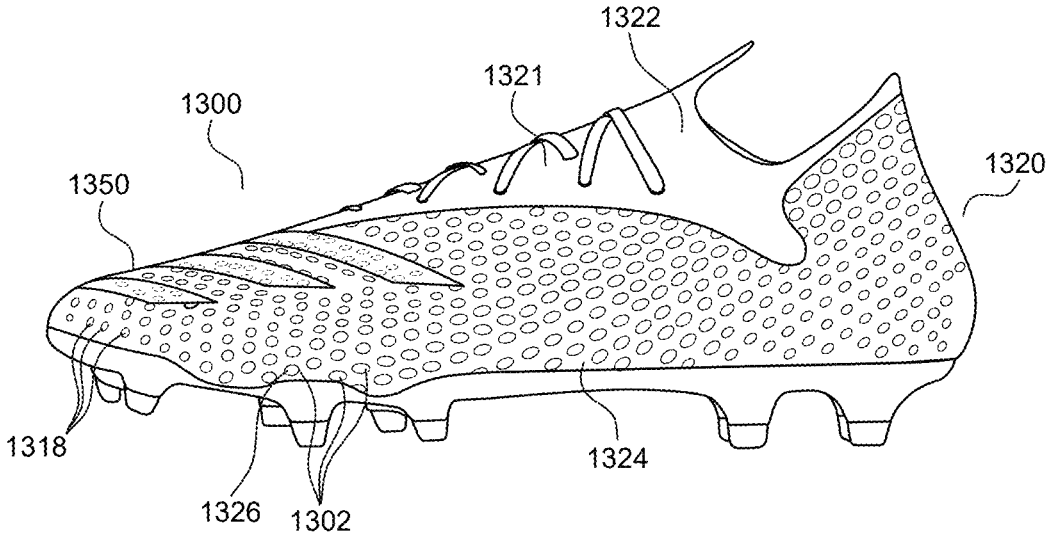
FIG. 13 shows a side view of an article of footwear according to some embodiments.

In some embodiments, as shown in FIG. 13, a rigid cage 1324 can wrap around a lateral side, a heel end, a medial side, and a toe end an upper 1320 of an article of footwear 1300 to form an upper cage 1350. In such embodiments, a tongue and collar section 1321 of footwear 1300 can comprise a textile layer 1322 that is coupled by an attachment process (e.g., adhesive bonding or stitching) to rigid cage 1324, a padding element 1326, or both. Rigid cage 1324 can be the same as or similar to rigid cage 124. Padding element 1326 can be the same as or similar to padding element 126. For example, padding element 1326 can comprise a plurality of projections 1318 disposed within, extending through, or varyingly disposed within and extending through a plurality of openings 1302 on rigid cage 1324. Further, textile layer 1322 can be the same as or similar to textile layer 122.

Where a range of numerical values comprising upper and lower values is recited herein, unless otherwise stated in specific circumstances, the range is intended to include the endpoints thereof, and all integers and fractions within the range. It is not intended that the disclosure or claims be limited to the specific values recited when defining a range. Further, when an amount, concentration, or other value or parameter is given as a range, one or more ranges, or as list of upper values and lower values, this is to be understood as specifically disclosing all ranges formed from any pair of any upper range limit or value and any lower range limit or value, regardless of whether such pairs are separately disclosed.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. An article of footwear, comprising:
a sole; and
an upper comprising:
a textile layer,
a rigid cage coupled to the sole along at least a portion of a bite line and comprising a plurality of openings formed in the cage, wherein at least a portion of an interior surface of the rigid cage overlaps an exterior surface of the textile layer, and
a padding element disposed between the textile layer and the rigid cage, the padding element comprising:
a base layer comprising an exterior surface facing the interior surface of the rigid cage, and an interior surface disposed opposite the exterior surface of the base layer and at least partially overlapping the exterior surface of the textile layer, and
a plurality of projections, each of the plurality of projections comprising an exterior protrusion extending from the exterior surface of the base layer and disposed within one of the openings in the rigid cage, and an interior protrusion extending from the interior surface of the base layer.

2. The article of footwear of claim 1, wherein the rigid cage wraps around a rearfoot portion of the article of footwear to form a heel cage.

3. The article of footwear of claim 1, wherein the rigid cage is integrally formed with the sole at the bite line.

4. The article of footwear of claim 1, wherein the padding element comprises an elastomeric foam.

5. The article of footwear of claim 1, wherein at least some of the plurality of exterior protrusions extend outward from the openings of the rigid cage.

6. The article of footwear of claim 1, wherein the plurality of interior protrusions comprise a height ranging from 1 mm to 6 mm.

7. The article of footwear of claim 1, wherein the plurality of interior protrusions comprise a height, and the height of respective interior protrusions varies on the interior surface of the base layer.

8. The article of footwear of claim 7, wherein a variation between the height of a shortest interior protrusion and the height of a tallest interior protrusion is at least 2 mm.

9. The article of footwear of claim 7, wherein the height of respective interior protrusions varies based on data from a foot scan map, the data comprising standard deviation values for variations in foot contour measured for a group of individuals.

10. The article of footwear of claim 1, wherein the plurality of interior protrusions comprise an effective diameter ranging from 2 mm to 30 mm.

11. The article of footwear of claim 1, wherein the plurality of interior protrusions comprise an effective diameter, and the effective diameter varies on the interior surface of the base layer.

12. The article of footwear of claim 11, wherein a variation between the effective diameter of a smallest interior protrusion and the effective diameter of a largest interior protrusion is at least 2 mm.

13. The article of footwear of claim 11, wherein the effective diameter of respective interior protrusions varies based on data from a foot scan map, the data comprising standard deviation values for variations in foot contour measured for a group of individuals.

14. The article of footwear of claim 1, wherein the plurality of exterior protrusions comprise a height, and the height of respective exterior protrusions varies on the exterior surface of the base layer.

15. The article of footwear of claim 14, wherein a first plurality of the exterior protrusions comprise a height that extends outward from an exterior surface of the rigid cage, and a second plurality of the exterior protrusions comprise a height disposed below the exterior surface of the rigid cage.

16. The article of footwear of claim 1, wherein the plurality of openings formed in the rigid cage comprise an effective diameter ranging from 1 mm to 30 mm.

17. The article of footwear of claim 1, wherein the plurality of openings formed in the rigid cage comprise an effective diameter, and the effective diameter varies on the rigid cage.

18. The article of footwear of claim 1, wherein the base layer and the plurality of projections are integrally formed as a single piece.

19. The article of footwear of claim 1, wherein the rigid cage comprises a rigid material having a durometer Shore hardness of at least 35D.

* * * * *